US012637965B2

(12) United States Patent
Thirumoolan et al.

(10) Patent No.: US 12,637,965 B2
(45) Date of Patent: May 26, 2026

(54) COMPLIANCE SPRING MOUNTING METHOD AND ASSEMBLY

(71) Applicant: Eaton Intelligent Power Limited, Dublin (IE)

(72) Inventors: Manickavasagan Thirumoolan, Neyveli (IN); Raghavendran R, Amman Nagar Trichy (IN); Ankita M. Bhirud, Jalgaon (IN); Pritam Edke, Pune (IN)

(73) Assignee: Eaton Intelligent Power Limited, Dublin (IE)

( * ) Notice: Subject to any disclaimer, the term of this patent is extended or adjusted under 35 U.S.C. 154(b) by 0 days.

(21) Appl. No.: 18/841,132

(22) PCT Filed: Feb. 27, 2023

(86) PCT No.: PCT/EP2023/025089
§ 371 (c)(1),
(2) Date: Aug. 23, 2024

(87) PCT Pub. No.: WO2023/160879
PCT Pub. Date: Aug. 31, 2023

(65) Prior Publication Data

US 2025/0075642 A1 Mar. 6, 2025

(30) Foreign Application Priority Data

Feb. 28, 2022 (IN) ..... 202211010663

(51) Int. Cl.
*F01L 1/18* (2006.01)

(52) U.S. Cl.
CPC ..... *F01L 1/181* (2013.01); *F01L 2305/00* (2020.05); *F01L 2800/17* (2013.01)

(58) Field of Classification Search
CPC ... F01L 1/181; F01L 2305/00; F01L 2800/17; F01L 1/18; F01L 1/24; F01L 1/46;
(Continued)

(56) References Cited

U.S. PATENT DOCUMENTS

2019/0277170 A1* 9/2019 Mandell ..... F01L 1/181

FOREIGN PATENT DOCUMENTS

EP 0573674 A1 * 12/1993 ..... B21K 1/205
WO 2010129790 11/2010
(Continued)

OTHER PUBLICATIONS

International Search Report and Written Opinion for PCT/EP2023/025089, dated Jun. 9, 2023, 10 pages.

*Primary Examiner* — Kelsey L Stanek
(74) *Attorney, Agent, or Firm* — Meunier Carlin & Curfman LLC

(57) ABSTRACT

A compliance spring assembly (50, 150) for applying a biasing force to a cam side (24) of a rocker arm (20A, 20B, 20C, 20D) to bias the cam side toward an adjacent cam (14). The compliance spring assembly includes a spring guide (52, 152) having a first end configured to engage the cam side of the rocker arm and a second end configured to slidingly engage a hole (36) in a fixed mount (32) positioned adjacent the cam side of the rocker arm. A compliance spring (62) engages a lower surface of the fixed mount and a spring mount (56, 156) formed on the spring guide. The compliance spring is compressed between the lower surface and the spring mount for apply the biasing force to the cam side of the rocker arm.

19 Claims, 7 Drawing Sheets

(58) Field of Classification Search
CPC ..... F01L 13/0005; F01L 13/001; F01L 13/06; F01L 2001/186; F01L 2001/467; F01L 1/267; F01L 1/047; F01L 9/26; F01L 13/065; F01L 1/08; F01L 1/30; F01L 13/0036; F01L 2303/00; F01L 2301/00
USPC ..... 123/90.1
See application file for complete search history.

(56) References Cited

FOREIGN PATENT DOCUMENTS

| | | |
|---|---|---|
| WO | 2021156008 | 8/2021 |
| WO | 2021164950 | 8/2021 |

* cited by examiner

COMPLIANCE SPRING MOUNTING METHOD AND ASSEMBLY

PRIORITY

This application claims the benefit of priority of Indian provisional patent application Ser. No. 202211010663, filed Feb. 28, 2022, the contents of which are incorporated herein by reference in their entirety.

FIELD

The subject application relates to, in general, a method and assembly for mounting a compliance spring. More particularly, this application relates to a spring guide mounted to a fixed mount that avoids buckling and/or failure of the compliance spring.

BACKGROUND

An internal combustion engine may utilize a compliance spring to apply force to a cam portion of a rocker arm to maintain cam-to-roller contact during operation. However, it is often difficult to configure the compliance spring so that it can be easily serviced by maintenance technicians.

SUMMARY OF THE INVENTION

There is provided a compliance spring assembly for applying a biasing force to a cam side of a rocker arm to bias the cam side toward an adjacent cam, The compliance spring assembly includes a spring guide having a first end configured to engage the cam side of the rocker arm and a second end configured to slidingly engage a hole in a fixed mount positioned adjacent the cam side of the rocker arm. A compliance spring engages a lower surface of the fixed mount and a spring mount formed on the spring guide. The compliance spring is compressed between the lower surface and the spring mount for apply the biasing force to the cam side of the rocker arm.

The foregoing compliance spring assembly, wherein the second end of the spring guide includes a bearing portion that is configured to slide within the hole of the fixed mount.

The foregoing compliance spring assembly, further including a sleeve positioned between the bearing portion and the hole of the fixed mount.

The foregoing compliance spring assembly, wherein threads are formed on the bearing portion for receiving a nut.

The foregoing compliance spring assembly, wherein during operation the spring guide is moveable a predetermined displacement distance between a first lowermost position and a second uppermost position. A lower surface of the nut is offset from an upper surface of the fixed mount when the spring guide is in the first lowermost position.

The foregoing compliance spring assembly, wherein a peripheral groove is formed on the bearing portion for receiving a retaining ring.

The foregoing compliance spring assembly, wherein during operation, the spring guide is moveable a predetermined displacement distance between a first lowermost position and a second uppermost position, wherein the retaining ring is offset from an upper surface of the fixed mount when the spring guide is in the first lowermost position.

The foregoing compliance spring assembly, wherein the spring mount is formed as an outwardly extending flange proximate the first end of the spring mount.

The foregoing compliance spring assembly, wherein the outwardly extending flange is configured to engage a seat formed on the rocker arm for supporting one of variable valve actuation, an intake valve or an exhaust valve.

The foregoing compliance spring assembly, wherein the spring guide includes a body portion have a first diameter. A pin portion extends from a distal end of the body portion. The pin portion has a second diameter less than the first diameter and is dimensioned to slide within the hole of the fixed mount.

The foregoing compliance spring assembly, wherein a sleeve is disposed on the pin portion for allowing the spring guide to slide relative to the hole in the fixed mount.

The foregoing compliance spring assembly, further including a nut threaded onto a distal end of the pin portion for capturing the sleeve between the nut and the body portion of the spring guide.

The foregoing compliance spring assembly, wherein during operation, the spring guide is moveable a predetermined displacement distance between a first lowermost position and a second uppermost position, wherein when the spring guide is in the first lowermost position a distance between the distal end of the body portion and the lower surface of the fixed mount is greater than the predetermined displacement distance.

There is further provided a compliance spring assembly configured to attach to a reaction bar for applying a biasing force to a cam side of a rocker arm to bias the cam side toward an adjacent cam. The compliance spring assembly includes a spring guide including a body portion have a first diameter. A pin portion extends from a first end of the body portion. The pin portion has a second diameter less than the first diameter and is configured to slidingly engage a hole in the reaction bar. A flange extends radially outward from a second end of the body portion. The flange is configured to engage the cam side of the rocker arm. A compliance spring is configured to be compressed between a lower surface of the reaction bar and the flange of the spring guide for applying the biasing force to the cam side of the rocker arm. A nut is configured to thread onto threads formed on a distal end of the pin portion for securing the spring guide to the reaction bar.

The foregoing compliance spring assembly, further including a sleeve positioned between the pin portion and the hole of the reaction bar.

The foregoing compliance spring assembly, wherein during operation the spring guide is moveable a predetermined displacement distance between a first lowermost position and a second uppermost position, wherein a lower surface of the nut is offset from an upper surface of the reaction bar when the spring guide is in the first lowermost position.

The foregoing compliance spring assembly, wherein during operation the spring guide is moveable a predetermined displacement distance between a first lowermost position and a second uppermost position, wherein when the spring guide is in the first lowermost position a distance between the distal end of the body portion and the lower surface of the reaction bar is greater than the predetermined displacement distance.

There is further provided a compliance spring assembly configured to attach to a reaction bar for applying a biasing force to a cam side of a rocker arm to bias the cam side toward an adjacent cam. The compliance spring assembly includes a spring guide including a body portion have a first diameter. A pin portion extends from a first end of the body portion. The pin portion has a second diameter less than the first diameter and is configured to slidingly engage a hole in the reaction bar. A flange extends radially outward from a second end of the body portion. The flange is configured to engage the cam side of the rocker arm. A compliance spring is configured to be compressed between a lower surface of the reaction bar and the flange of the spring guide for applying the biasing force to the cam side of the rocker arm. A retaining ring is attached to a distal end of the pin portion for securing the spring guide to the reaction bar.

The foregoing compliance spring assembly, wherein during operation the spring guide is moveable a predetermined displacement distance between a first lowermost position and a second uppermost position, wherein when the spring guide is in the first lowermost position a distance between the distal end of the body portion and the lower surface of the reaction bar is greater than the predetermined displacement distance.

The foregoing compliance spring assembly, wherein during operation the spring guide is moveable a predetermined displacement distance between a first lowermost position and a second uppermost position, wherein the retaining ring is offset from an upper surface of the reaction bar when the spring guide is in the first lowermost position.

DETAILED DESCRIPTION

The following presents a description of the disclosure; however, aspects may be embodied in many different forms and should not be construed as limited to the embodiments set forth herein. Furthermore, the following examples may be provided alone or in combination with one or any combination of the examples discussed herein. Directional references such as "left" and "right" are for ease of reference to the figures.

Figure 1:
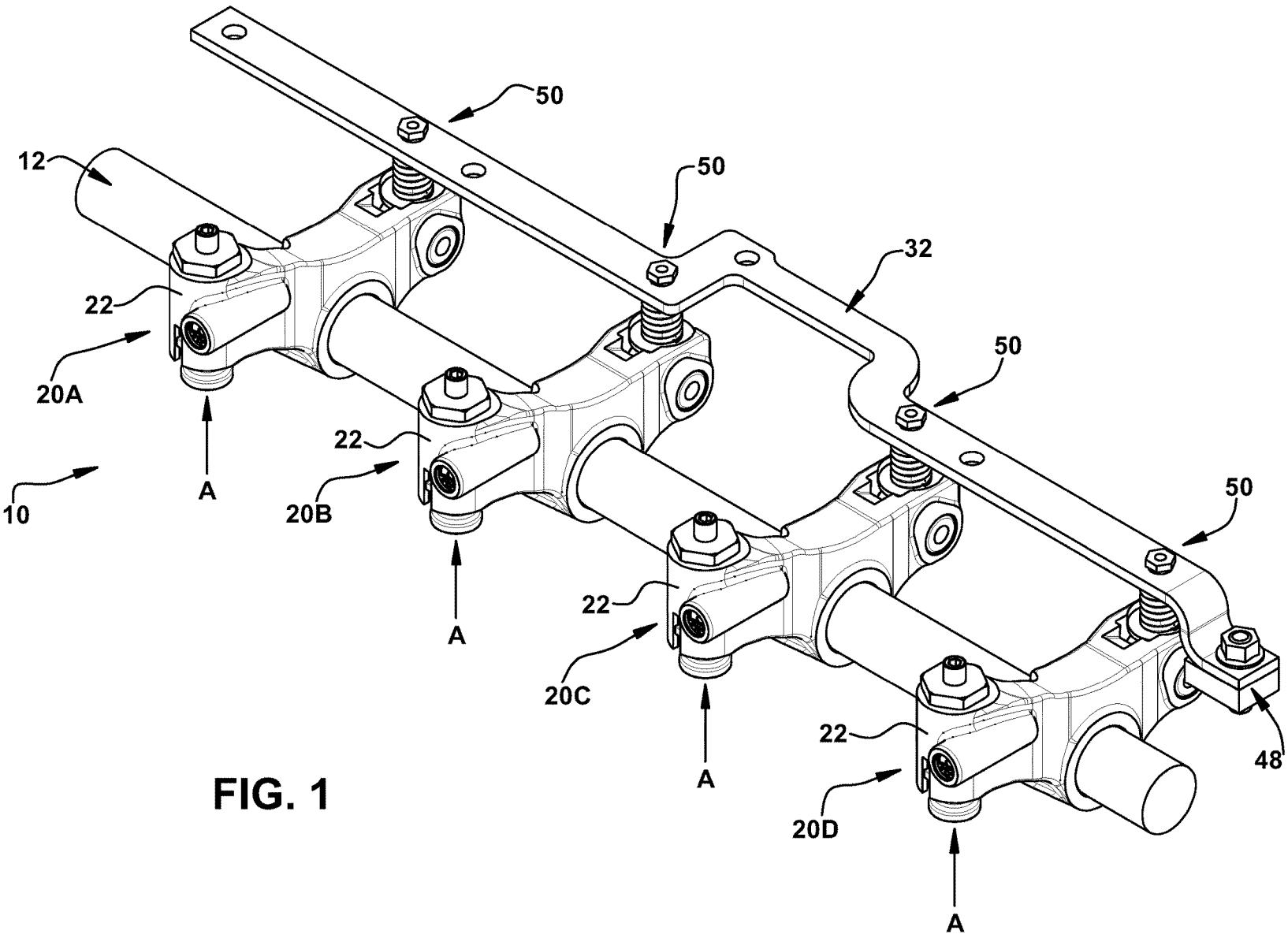
FIG. 1 is a top perspective view of a valve train assembly.
Figure 2A:
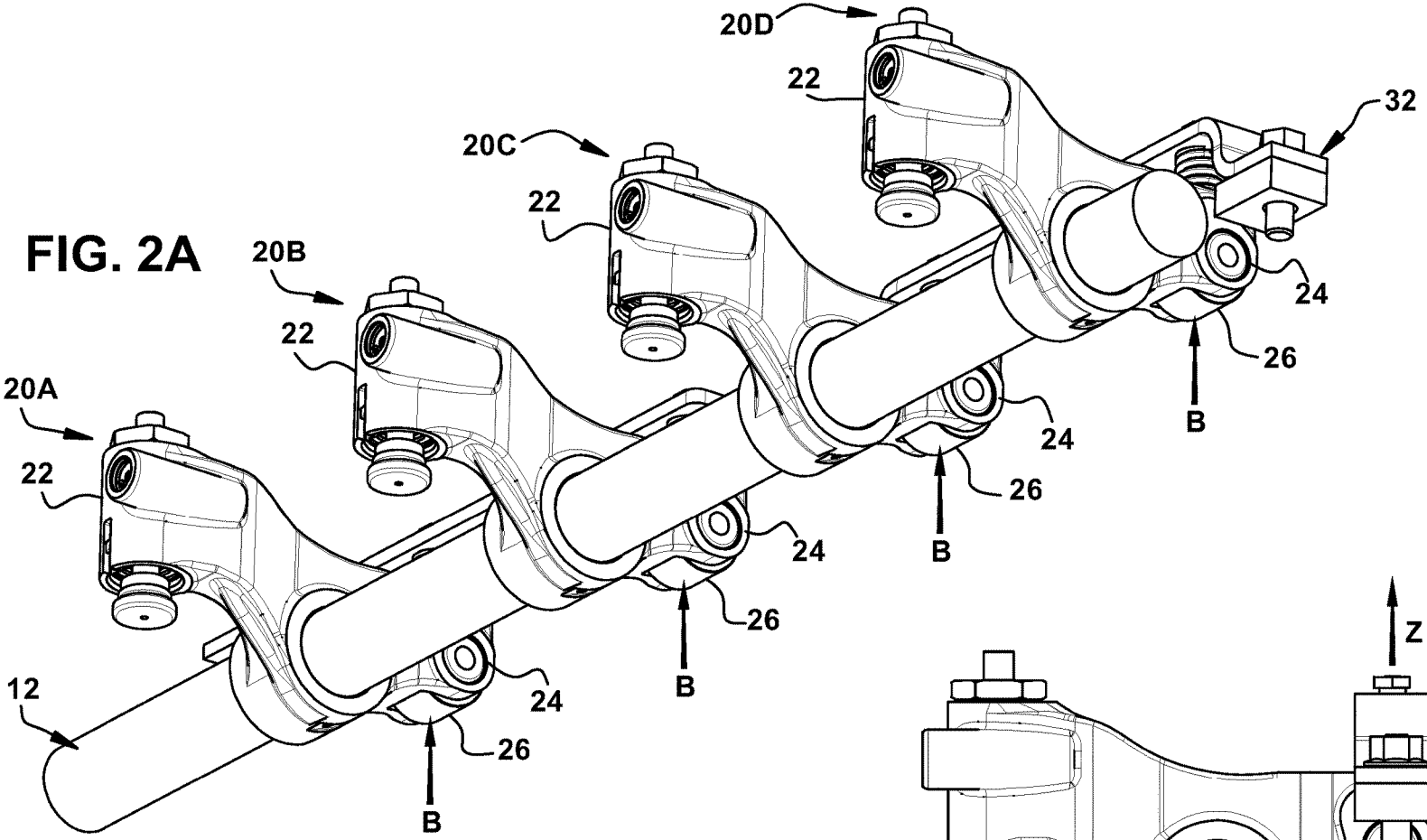
FIG. 2A is a bottom perspective view of the valve train assembly of FIG. 1.
Figure 2B:
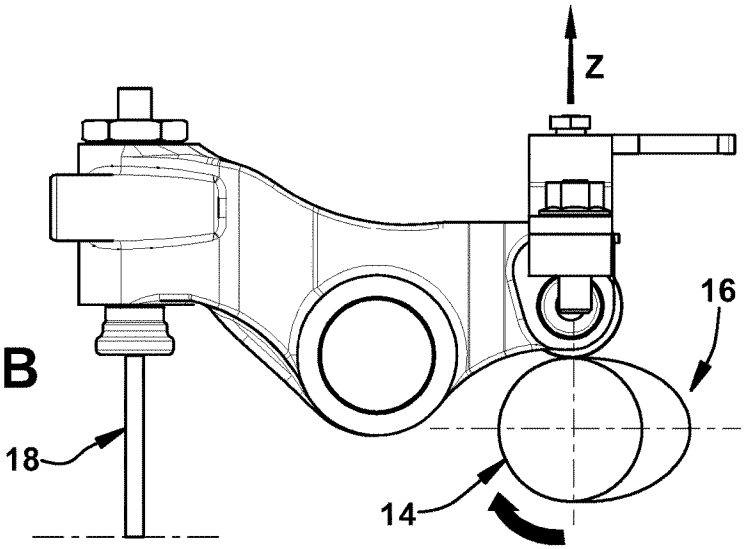
FIG. 2B is a side view of the valve train assembly of FIG. 1 adjacent a cam.

Referring to FIGS. 1, 2A and 2B, a valve train system 10 includes, in general, a plurality of rocker arms 20A, 20B 20C, 20D that are configured to rotate on a rocker shaft 12. Each rocker arm 20A, 20B, 20C, 20D includes a valve side 22 that is configured to engage a valve 18 (partially shown in FIG. 2B) at location A and a cam side 24 that is configured to engage a cam 14 at location B. A roller 26 is positioned on the cam side 24 for engaging the cam 14 at the location B. The cam 14 includes a lobe 16 that, as the cam 14 rotates, engages the roller 26 and causes the rocker arm 20A, 20B, 20C, 20D to pivot about the rocker shaft 12. This pivoting causes the cam side 24 to move in the z-direction (see FIG. 2B) a predetermined maximum displacement relative the cam 14. When the roller 26 is on a base circle of the cam 14, the cam side 24 is at its lowermost position in the z-direction. When the roller 26 is at the largest diameter of the lobe 16, the cam side 24 is at its uppermost position in the z-direction.

A compliance spring assembly 50 is position adjacent each rocker arm 20A, 20B, 20C, 20D. In the embodiment illustrated, a single fixed mount 32 extends adjacent four rocker arms 20A, 20B, 20C, 20D to position one compliance spring assembly 50 adjacent each rocker arm 20A, 20B, 20C, 20D. In the embodiment illustrated, the fixed mount 32 is a single reaction bar that extends adjacent the four rocker arms 20A, 20B, 20C, 20D. It is contemplated that the fixed mount 32 may be placed adjacent any number of rocker arms or that a separate fixed mount 32 may be provided for each compliance spring assembly 50. It is contemplated that compliance spring assembly 50 may support a rocker arm with variable valve actuation in addition to supporting a standard intake/exhaust rocker arm.

Figure 3:
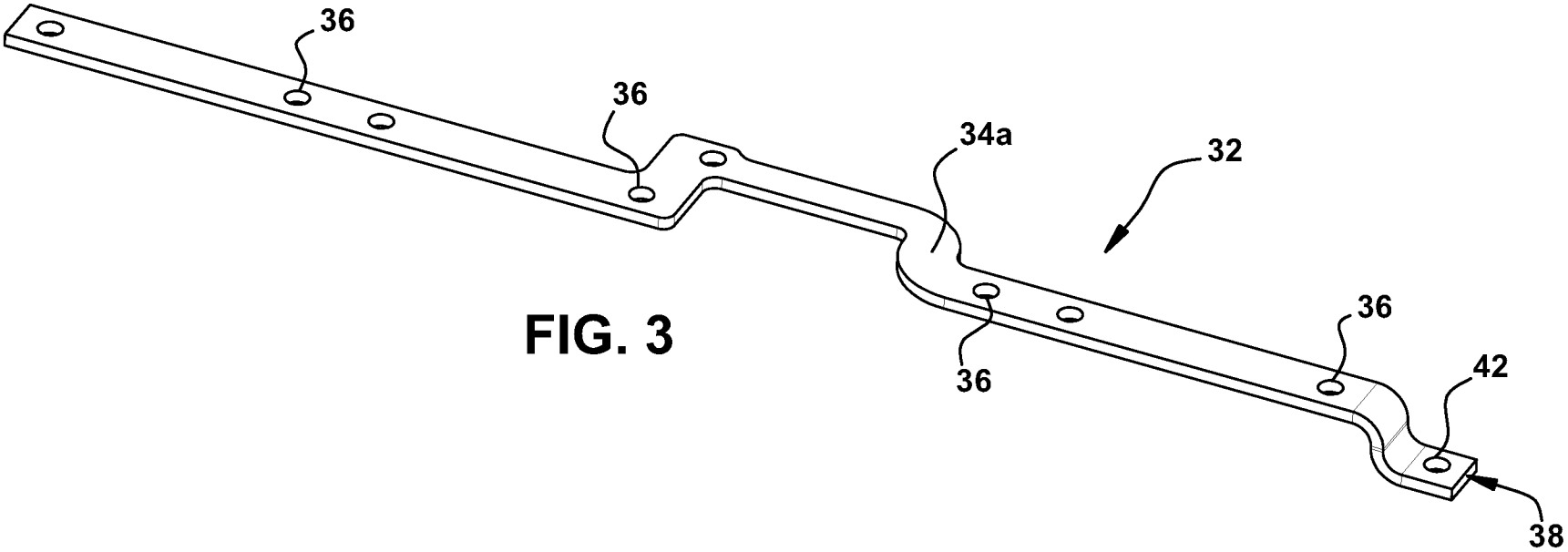
FIG. 3 is a top perspective view of a fixed mount of the valve train assembly of FIG. 1.
Figure 4:
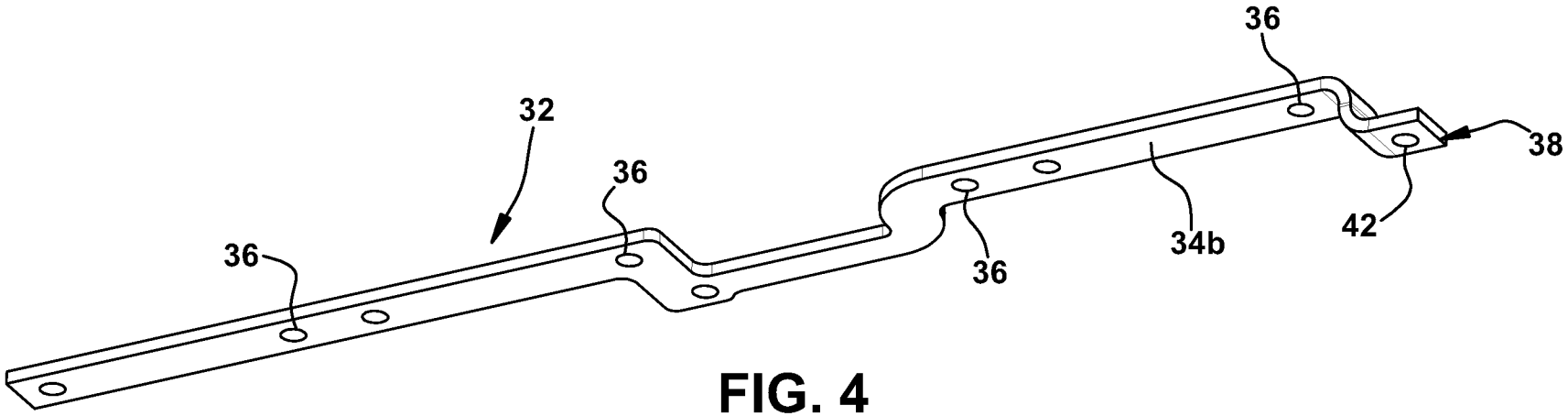
FIG. 4 is a bottom perspective view of the fixed mount of FIG. 3.
Figure 6:
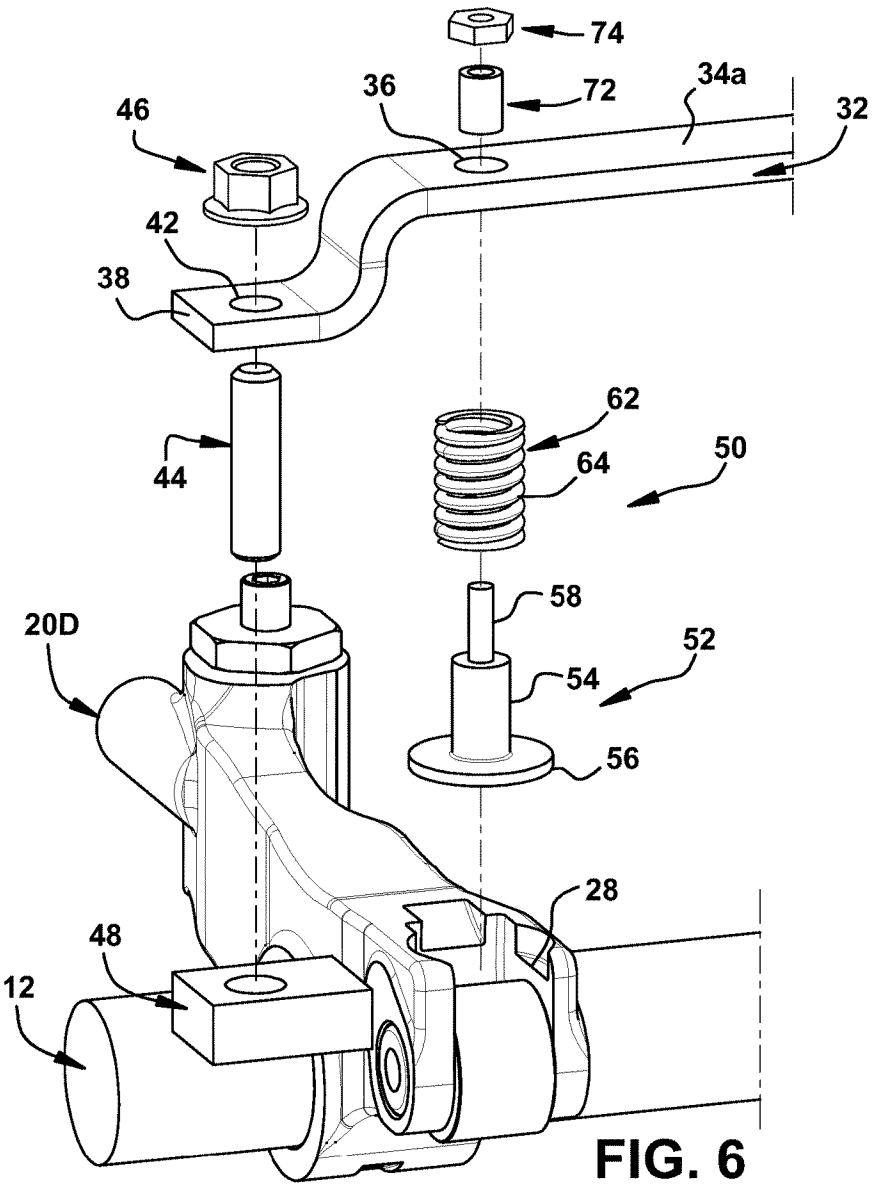
FIG. 6 is an exploded view of the compliance spring assembly of FIG. 5.

Referring to FIGS. 3 and 4, the fixed mount 32 is an elongated element having a rectangular cross section with an upper surface 34*a* and a lower surface 34*b*. A plurality of holes 36 are extend through the fixed mount 3 at discrete locations along a length of the fixed mount 32. The holes 36 extend from the upper surface 34*a* to the lower surface 34*b*. The fixed mount 32 is formed to define a mounting foot 38 at one end of the fixed mount 32. In the embodiment illustrated, the mounting foot 38 is offset from a body of the fixed mount 32. A mounting hole 42 extends through the mounting foot 38 to receive a mounting stud 44 (FIG. 6). The mounting stud 44 threads into a cylinder head 48 (partially shown in FIG. 1) and a mounting nut 46 threads onto the mounting stud 44 to secure the fixed mount 32 to the cylinder head 48.

Figure 5:
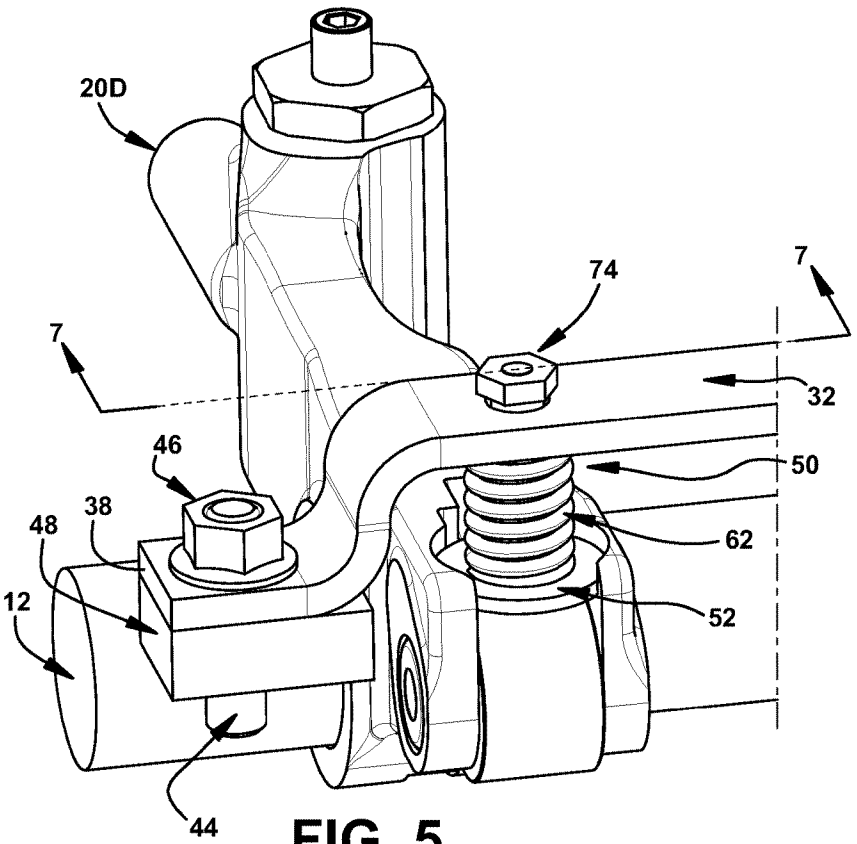
FIG. 5 is an enlarged view of a compliance spring assembly adjacent a rocker arm.

Referring to FIGS. 5 and 6, the compliance spring assembly 50 adjacent to the rocker arm 20D is illustrated. The other compliance spring assemblies 50 are similar and are not described in detail. The compliance spring assemblies 50 includes a spring guide 52, a spring 62, a sleeve 72 and a nut 74.

Referring to FIG. 6, the spring guide 52 is a rod-shaped element having a body portion 54. A flange 56 extends radially outward from a first end of the body portion 54. A pin portion 58 extends axially from a second end of the body portion 54. In the embodiment illustrated, the body portion 4, the flange 56 and the pin portion 58 are all cylindrical in shape. Threads are formed on a distal portion of the pin portion 58 for receiving the nut 74, as described in detail below.

The spring 62 is dimensioned to be received around the spring guide 52. The spring 62 includes a plurality of coils 64 that have a diameter smaller than the flange 56. The body portion 54 of the spring guide 52 is dimensioned to be slightly smaller than the inner diameter of the coils 64 of the spring 62 to reduce the potential of the spring 62 buckling during operation.

The sleeve 72 is dimension to be received on the pin portion 58 of the spring guide 52. The sleeve 72 has an outer diameter that is smaller than an inner diameter of a respective hole 36 in the fixed mount 32 to allow the sleeve 72 to slide relative to the hole 36. The sleeve 72 may be made of a material that allows low friction sliding of the sleeve 72 in the hole 36, for example, but not limited to, copper.

The nut 74 is dimensioned to thread on the threads of the pin portion 58 of the spring guide 52. The nut 74 is configured to retain the sleeve 72 on the pin portion 58.

The compliance spring assembly 50 is assembled to the rocker assembly 20D by placing the spring guide 52 in the respective rocker arm 20D. In particular, a lower surface of the flange 56 of the spring guide 52 is dimensioned to engage a seat 28 formed in the rocker arm 20D. The spring 62 is placed on the spring guide 52 such that the body portion 54 and the pin portion 58 extend through the coils 64 of the spring 62. The sleeve 72 is placed on the pin portion 58.

The fixed mount 32 is positioned such that the mounting stud 44 extends through the mounting hole 42 in the mounting foot 38 of the fixed mount 32. As the fixed mount 32 is lowered on the mounting stud 44, the holes 36 align with the respective pin portions 58 of the spring guides 52. The mounting nut 46 is then threaded and torqued onto the mounting stud 44 to draw the fixed mount 32 toward the respective rocker arms 20A, 20B, 20C, 20D.

The spring guide 52, spring 62 and seat 28 are dimensioned such that as the mounting nut 46 is tightened, the spring 62 is compressed between the lower surface 34*b* of the fixed mount 32 and the flange 56 of the spring guide 52. In this respect, the spring 62 is preloaded by tightening the mounting nut 46.

Figure 7:
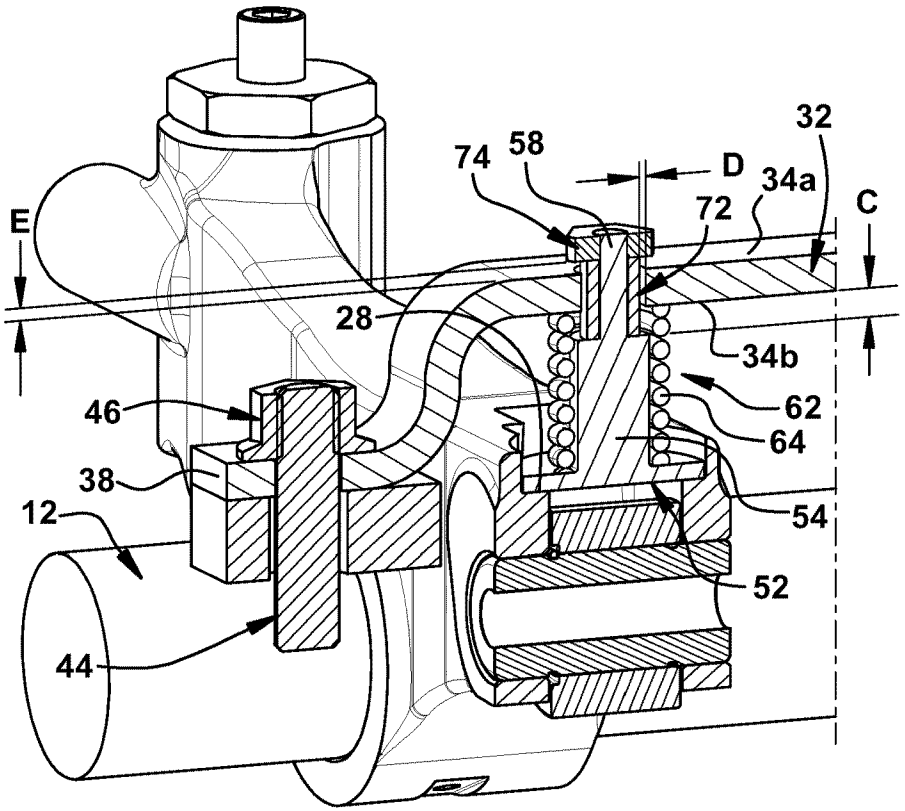
FIG. 7 is a sectional view taken along line 7-7 of FIG. 5.

Once the spring 62 is pre-loaded, the nut 74 is threaded onto the threads of the pin portion 58 to secure the compliance spring assembly 50 to the respective rocker arm 20A, 20B, 20C, 20D. As illustrated in FIG. 7, the sleeve 72 is on the pin portion 58 of the spring guide 52 such that pin portion defines a bearing portion of the spring guide 52.

Referring to FIG. 7, the body portion 54 and the pin portion 58 of the spring guide 52 are dimensioned such that, when the cam side 24 is at is lowermost position (i.e., the roller 26 is on the base circle of the cam 14), a gap C is formed between the lower surface 34*b* of the fixed mount 32 and the first end of the body portion 54. The gap C is dimensioned to be greater than the maximum displacement imparted to the respective rocker arm 20A, 20B, 20C, 20D by the lobe 16 of the respective cam 14. The gap C is selected so the spring 62 applies pressure to the respective rocker arm 20A, 20B, 20D, 20C throughout the range of lift of the cam side 24.

The outer diameter of the sleeve 72 is dimensioned to be smaller than the inner diameter of the hole 36 to define a gap D therebetween. The gap D is selected to allow the sleeve 72 to easily slide within the hole 36. As illustrated, the sleeve 72 is retained between the nut 74 and the body portion 54 of the spring guide 52 such that the sleeve 72 moves with the spring guide 52 as a single unit relative to the fixed mount 32.

A length of the spring guide 52 is selected so that when the cam side 24 of the rocker arm 20A, 20B, 20C, 20D is at its lowermost position (i.e., the roller 26 is on the base circle of the cam 14), there is a gap E between a bottom of the nut 74 and the upper surface 34*a* of the fixed mount 32. This gap E is selected to be greater than zero so that the spring 62 always applies a force to the cam side 24 of the rocker arm 20A, 20B, 20C, 20D during operation.

Figure 8:
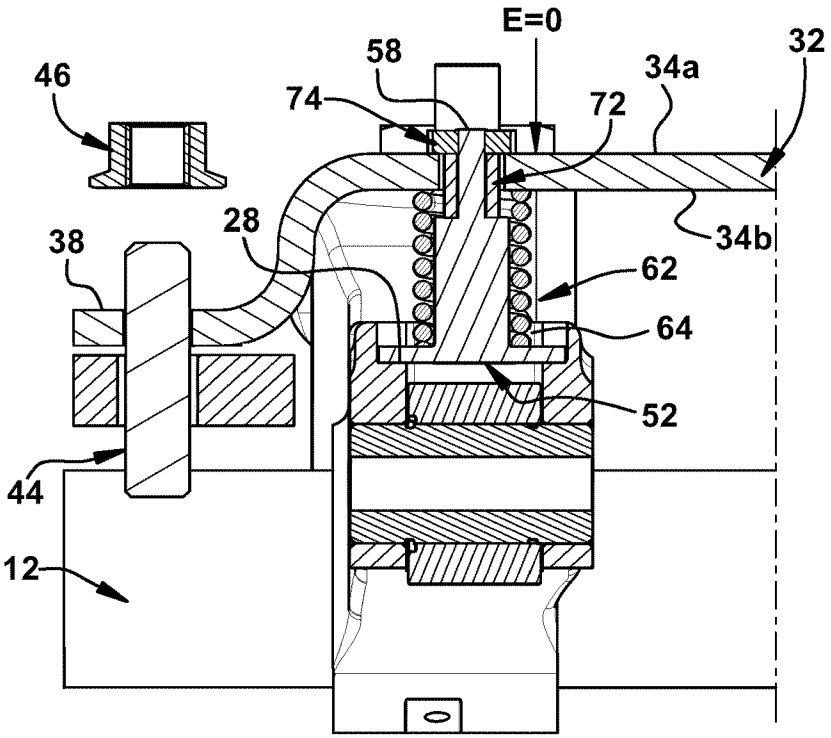
FIG. 8 is a sectional view taken along line 7-7 of FIG. 5 illustrating the compliance spring assembly partially disassembled.

Referring to FIG. 8, the removal of the compliance assembly 50 will now be described. The compliance assembly 50 is removed by untreading the mounting nut 46 from the mounting stud 44. As the mounting nut 46 is untreaded, the spring 62 applies an upward force to the lower surface 34*b* of the fixed mount 32 thereby causing the fixed mount 32 to move toward the bottom of the nut 74. The motion of the fixed mount 32 toward the nut 74 causes the gap E to decrease until the upper surface 34*a* of the fixed mount 32 abuts the bottom of the nut 74 (i.e., the gap E is reduced to zero). The nut 74 thereafter maintains the compliance spring assembly 50 connected to the fixed mount 32 after the mounting nut 46 is completely unthreaded from the mounting stud 44.

The present invention thereby maintains the compliance spring assemblies 50 connected to the fixed mount 32 during maintenance to reduce the risk that the components of the compliance spring assembly 50 may be lost during maintenance.

Figure 9:
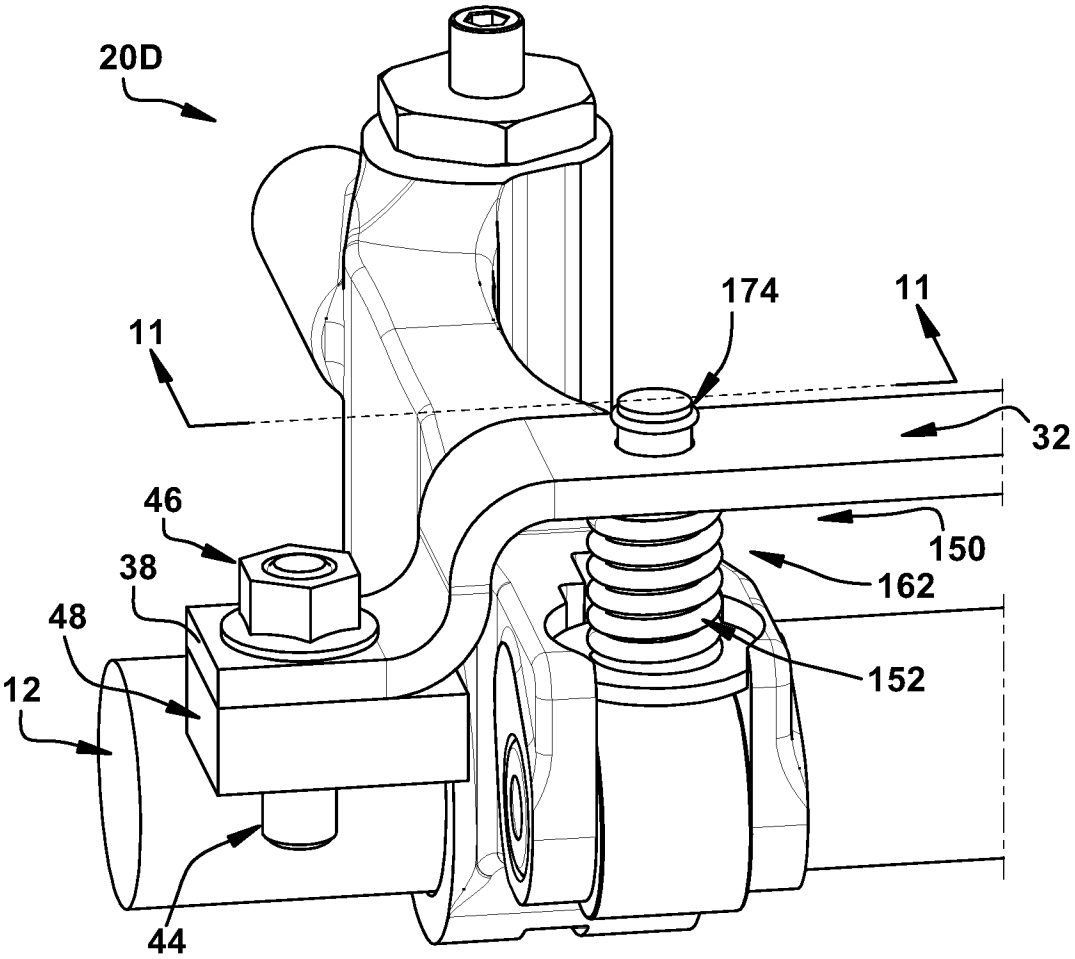
FIG. 9 is an enlarged view of a compliance spring assembly according to a second embodiment adjacent a rocker arm.
Figure 11:
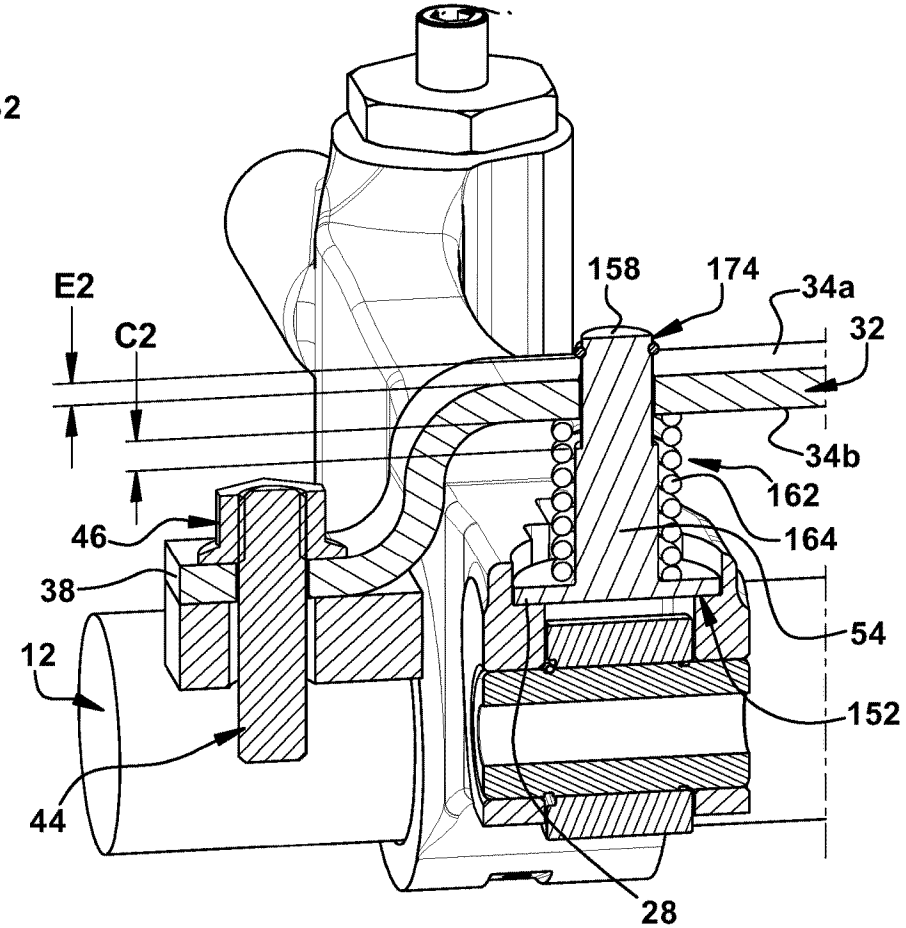
FIG. 11 is a sectional view taken along line 11-11 of FIG. 9.
Figure 10:
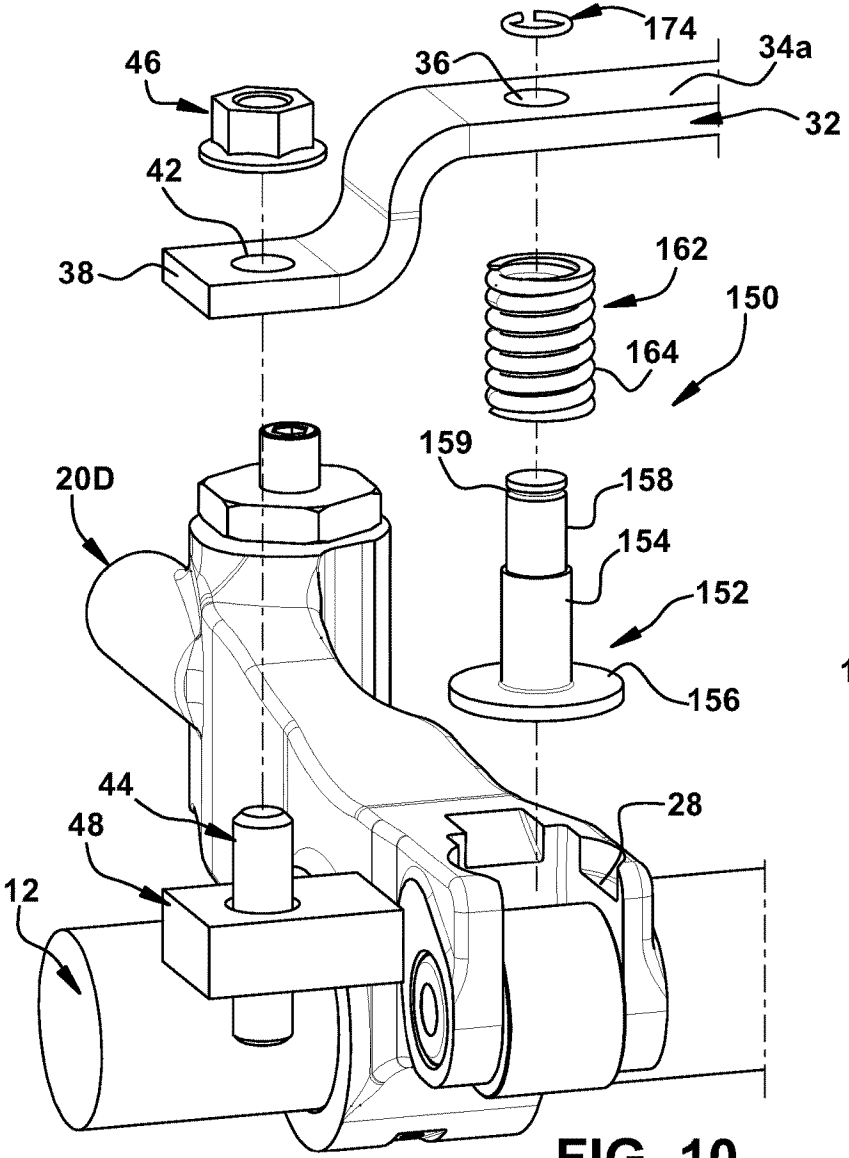
FIG. 10 is an exploded view of the compliance spring assembly of FIG. 9.

According to another embodiment, illustrated in FIGS. 9-11, a compliance spring assembly 150 similar to the compliance spring assembly 50 is shown. The compliance spring assembly 150 includes similar components to the compliance assembly 50. Similar components are referred to with similar reference numbers and a detailed description of similar components is not provided hereinbelow.

The compliance spring assembly 150 includes a retaining ring 174 instead of the nut 74, as in the compliance spring assembly 50. Referring to FIG. 10, a peripheral groove 159 is formed in the pin portion 158 of the spring guide 152. The peripheral groove 159 is dimensioned to receive the retaining ring 174.

Similar to the compliance spring assembly 50, the compliance spring assembly 150 is assembled to the respective rocker arm 20A, 20B, 20C, 20D by first placing the spring guide 152 into contact with the seat 28 of the rocker arm 20A, 20B, 20C, 20D. Thereafter, the spring 162 is placed such that the body portion 154 and the pin portion 158 extend through the coils 164 of the spring 162. The fixed mount 32 is then positioned such that the mounting stud 44 extends through the mounting hole 42 in the mounting foot 38 and the pin portion 158 extends through the respective hole 36. The mounting nut 46 is then tightened on the mounting stud 44 to draw the fixed mount 32 toward the seat 28 of the rocker arm 20A, 20B, 20C, 20D. As the mounting nut 46 is tightened, the spring 162 is compressed between the lower surface 34*b* of the fixed mount 32 and the flange 156 of the spring guide 152. Once the mounting nut 46 is fully tightened, the retaining ring 174 is placed in the peripheral groove 159 on the pin portion 158.

Once the compliance spring assembly 150 is assembled to the fixed mount 32, the retaining ring 174, similar to the nut 74 in the compliance spring assembly 50, functions to maintain the compliance spring assembly 150 connected to the fixed mount 32.

Referring to FIG. 11, the body portion 154 and the pin portion 158 of the spring guide 152 are dimensioned such that, when the cam side 24 is at is lowermost position (i.e., the roller 26 is on the base circle of the cam 14), a gap C2 is formed between the lower surface 34*b* of the fixed mount 32 and the first end of the body portion 54. The gap C2 is dimensioned to be greater than the maximum displacement imparted to the respective rocker arm 20A, 20B, 20C, 20D by the lobe 16 of the respective cam 14. The gap C2 is selected so the spring 162 applies pressure to the respective rocker arm 20A, 20B, 20D, 20C throughout the range of lift of the cam side 24.

The outer diameter of the pin portion 158 is dimensioned to be smaller than the inner diameter of the hole 36 to define a gap therebetween. The gap is selected to allow the pin portion 158 to easily slide within the hole 36.

A length of the spring guide 152 is selected so that when the cam side 24 of the rocker arm 20A, 20B, 20C, 20D is at its lowermost position (i.e., the roller 26 is on the base circle of the cam 14), there is a gap E2 between a bottom of the retaining ring 174 and the upper surface 34*a* of the fixed mount 32. This gap E2 is selected to be greater than zero so that the spring 162 always applies a force to the cam side 24 of the rocker arm 20A, 20B, 20C, 20D during operation.

Similar to the compliance assembly 50, the compliance spring assembly 150 is removed by untreading the mounting nut 46 from the mounting stud 44. As the mounting nut 46 is untreaded, the spring 62 applies an upward force to the lower surface 34*b* of the fixed mount 32 thereby causing the fixed mount 32 to move toward the bottom of the retaining ring 174. The motion of the fixed mount 32 toward the retaining ring 174 causes the gap E2 to decrease until the upper surface 34*a* of the fixed mount 32 abuts the retaining ring 174 (i.e., the gap E2 is reduced to zero). The retaining ring 174 thereafter maintains the compliance spring assembly 150 connected to the fixed mount 32 after the mounting nut 46 is completely unthreaded from the mounting stud 44.

It will be apparent to those skilled in the art that various modifications and variations can be made without departing from the spirit and scope of the claimed invention.

What we claim is:

1. A compliance spring assembly for applying a biasing force to a cam side of a rocker arm to bias the cam side toward an adjacent cam, the compliance spring assembly comprising:

a spring guide having a first end configured to engage the cam side of the rocker arm and a second end configured to slidingly engage a hole in a mount positioned adjacent the cam side of the rocker arm; and a compliance spring engaging a lower surface of the mount and a spring mount formed on the spring guide, wherein the compliance spring is compressed between the lower surface and the spring mount for applying the biasing force to the cam side of the rocker arm, wherein the spring guide further includes a body portion having a first diameter and a pin portion extending from a distal end of the body portion, the pin portion having a second diameter less than the first diameter and dimensioned to slide within the hole of the mount.

2. The compliance spring assembly of claim 1, wherein the second end of the spring guide includes a bearing portion that is configured to slide within the hole of the mount.

3. The compliance spring assembly of claim 2, wherein threads are formed on the bearing portion for receiving a nut.

4. The compliance spring assembly of claim 3, wherein during operation the spring guide is moveable a predetermined displacement distance between a first lowermost position and a second uppermost position, wherein a lower surface of the nut is offset from an upper surface of the mount when the spring guide is in the first lowermost position.

5. The compliance spring assembly of claim 2, wherein a peripheral groove is formed on the bearing portion for receiving a retaining ring.

6. The compliance spring assembly of claim 5, wherein during operation the spring guide is moveable a predetermined displacement distance between a first lowermost position and a second uppermost position, wherein the retaining ring is offset from an upper surface of the mount when the spring guide is in the first lowermost position.

7. The compliance spring assembly of claim 1, wherein the mount is a reaction bar that is fixed or secured to a cylinder head.

8. The compliance spring assembly of claim 1, wherein the spring mount is formed as an outwardly extending flange proximate the first end of the spring mount.

9. The compliance spring assembly of claim 8, wherein the outwardly extending flange is configured to engage a seat formed on the rocker arm for supporting one of variable valve actuation, an intake valve or an exhaust valve.

10. The compliance spring assembly of claim 1, wherein a sleeve is disposed on the pin portion for allowing the spring guide to slide relative to the hole in the mount.

11. The compliance spring assembly of claim 10, further comprising a nut threaded onto a distal end of the pin portion for capturing the sleeve between the nut and the body portion of the spring guide.

12. The compliance spring assembly of claim 1, wherein during operation the spring guide is moveable a predetermined displacement distance between a first lowermost position and a second uppermost position, wherein when the spring guide is in the first lowermost position a distance between the distal end of the body portion and the lower surface of the mount is greater than the predetermined displacement distance.

13. A compliance spring assembly configured to attach to a reaction bar for applying a biasing force to a cam side of a rocker arm to bias the cam side toward an adjacent cam, the compliance spring assembly comprising:

a spring guide comprising:

a body portion have a first diameter, a pin portion extending from a first end of the body portion, the pin portion having a second diameter less than the first diameter and configured to slidingly engage a hole in the reaction bar, and a flange extending radially outward from a second end of the body portion, the flange configured to engage the cam side of the rocker arm; and a compliance spring configured to be compressed between a lower surface of the reaction bar and the flange of the spring guide for applying the biasing force to the cam side of the rocker arm; and a nut configured to thread onto threads formed on a distal end of the pin portion for securing the spring guide to the reaction bar.

14. The compliance spring assembly of claim 13, further comprising a sleeve positioned between the pin portion and the hole of the reaction bar.

15. The compliance spring assembly of claim 13, wherein during operation the spring guide is moveable a predetermined displacement distance between a first lowermost position and a second uppermost position, wherein a lower surface of the nut is offset from an upper surface of the reaction bar when the spring guide is in the first lowermost position.

16. The compliance spring assembly of claim 13, wherein during operation the spring guide is moveable a predetermined displacement distance between a first lowermost position and a second uppermost position, wherein when the spring guide is in the first lowermost position a distance between the distal end of the body portion and the lower surface of the reaction bar is greater than the predetermined displacement distance.

17. A compliance spring assembly configured to attach to a reaction bar for applying a biasing force to a cam side of a rocker arm to bias the cam side toward an adjacent cam, the compliance spring assembly comprising:

a spring guide comprising:

a body portion have a first diameter, a pin portion extending from a first end of the body portion, the pin portion having a second diameter less than the first diameter and configured to slidingly engage a hole in the reaction bar, and a flange extending radially outward from a second end of the body portion, the flange configured to engage the cam side of the rocker arm; and a compliance spring configured to be compressed between a lower surface of the reaction bar and the flange of the spring guide for applying the biasing force to the cam side of the rocker arm; and, a retaining ring attached to a distal end of the pin portion for securing the spring guide to the reaction bar.

18. The compliance spring assembly of claim 17, wherein during operation the spring guide is moveable a predetermined displacement distance between a first lowermost position and a second uppermost position, wherein when the spring guide is in the first lowermost position a distance between the distal end of the body portion and the lower surface of the reaction bar is greater than the predetermined displacement distance.

19. The compliance spring assembly of claim 17, wherein during operation the spring guide is moveable a predetermined displacement distance between a first lowermost position and a second uppermost position, wherein the retaining ring is offset from an upper surface of the reaction bar when the spring guide is in the first lowermost position.

* * * * *